US011268700B2

(12) United States Patent
Uribe

(10) Patent No.: US 11,268,700 B2
(45) Date of Patent: Mar. 8, 2022

(54) GAS BURNER AND HOB COMPRISING A GAS BURNER

(71) Applicant: ELECTROLUX APPLIANCES AKTIEBOLAG, Stockholm (SE)

(72) Inventor: Areli Uribe, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 42 days.

(21) Appl. No.: 16/626,611

(22) PCT Filed: Jun. 25, 2018

(86) PCT No.: PCT/EP2018/066956

§ 371 (c)(1),
(2) Date: Dec. 26, 2019

(87) PCT Pub. No.: WO2019/007739

PCT Pub. Date: Jan. 10, 2019

(65) Prior Publication Data

US 2020/0124288 A1 Apr. 23, 2020

(30) Foreign Application Priority Data

Jul. 7, 2017 (EP) ..... 17180169

(51) Int. Cl.
*F24C 3/08* (2006.01)
*F23D 14/06* (2006.01)
(Continued)

(52) U.S. Cl.
CPC ..... *F24C 3/085* (2013.01); *F23D 14/06* (2013.01); *F23D 14/64* (2013.01); *F23D 14/84* (2013.01);
(Continued)

(58) Field of Classification Search
CPC ..... F24C 3/085; F23D 14/06; F23D 14/84; F23D 23/00
(Continued)

(56) References Cited

U.S. PATENT DOCUMENTS 6,132,205 A 10/2000 Harneit
8,973,569 B2 * 3/2015 Padgett ..... F23D 14/06 126/39 E
(Continued)

FOREIGN PATENT DOCUMENTS

CN 2823848 10/2006
CN 101089468 12/2007
(Continued)

OTHER PUBLICATIONS

Chinese Office action for application No. CN 201880044608.0, dated Nov. 3, 2020 (translation), 9 pages.
(Continued)

*Primary Examiner* — Nivek K Shirsat
(74) *Attorney, Agent, or Firm* — Pearne & Gordon LLP

(57) ABSTRACT

The invention relates to a gas burner comprising: —an injection holder (2) with at least three gas injectors (2.1, 2.2, 2.3); —a burner crown assembly (3), the burner crown assembly comprising at least three flame rings (FR1, FR2, FR3) with different sizes, the burner crown assembly further comprising at least three chambers (CH1, CH2, CH3) and at least three pipes (3.1.1, 3.1.2, 3.1.3), each pipe being fluidly coupled with a single chamber; wherein each gas injector is associated with one of said pipes for providing gas into said pipe, said pipe being adapted to receive primary air in the area of the injection holder and to provide a combustion mixture of gas and primary air to one of said flame rings of the burner crown assembly. In addition, adjacent flame rings
(Continued)

are separated from each other based on an air gap (AG1, AG2) provided between said adjacent flame rings.

20 Claims, 4 Drawing Sheets

(51) Int. Cl.

| | |
|---|---|
| ***F23D 14/64*** | (2006.01) |
| ***F23D 14/84*** | (2006.01) |
| ***F23D 23/00*** | (2006.01) |
| ***F23L 9/00*** | (2006.01) |
| ***F23Q 3/00*** | (2006.01) |

(52) U.S. Cl.
CPC ..... *F23D 23/00* (2013.01); *F23L 9/00* (2013.01); *F23Q 3/008* (2013.01); *F23D 2203/1017* (2013.01); *F23D 2205/00* (2013.01); *F23D 2208/00* (2013.01); *F23D 2900/14062* (2013.01); *F23D 2900/14641* (2013.01)

(58) Field of Classification Search
USPC ..... 126/39 E, 39 R, 39 H
See application file for complete search history.

(56) References Cited

U.S. PATENT DOCUMENTS

| | | | | |
|---|---|---|---|---|
| 2010/0206293 | A1 | 8/2010 | Padgett et al. | |
| 2010/0279238 | A1* | 11/2010 | Harneit ..... | F23L 1/00 431/144 |
| 2017/0003033 | A1* | 1/2017 | Lona Santoyo ..... | F24C 3/124 |

FOREIGN PATENT DOCUMENTS

| | | | |
|---|---|---|---|
| CN | 201606877 | | 10/2010 |
| CN | 205279084 | | 6/2016 |
| EP | 2618054 | A2 | 7/2013 |
| FR | 715717 | A | 12/1931 |
| FR | 749529 | A | 7/1933 |
| FR | 1220131 | A | 5/1960 |
| WO | 2014082755 | A1 | 6/2014 |
| WO | 2014191825 | A1 | 12/2014 |

OTHER PUBLICATIONS

International Search Report & Written Opinion in PCT/EP2018/066956 dated Sep. 10, 2018, 10 pages.
European Office action for application No. 17180169.9, dated Jul. 22, 2021, 7 pages.

* cited by examiner

GAS BURNER AND HOB COMPRISING A GAS BURNER

Generally, the present invention relates to the field of gas burners. More specifically, the present invention relates to a gas burner with multiple flame rings comprising different sizes for providing different heating power levels within a single gas burner.

BACKGROUND OF THE INVENTION

Gas burners are well-known in prior art. Specifically, cooking hob gas burners are known which comprise an injection holder and a burner crown assembly. Within said burner crown assembly, a combustion gas chamber is arranged which provides a mixture of gas and primary air to a flame ring comprising a plurality of flame ports.

Gas hobs are known which comprise multiple separated gas burners of different sizes, specifically, different diameters in order to provide burners with different heating power levels.

Disadvantageously, current gas hobs are not capable of providing heat at multiple high-power, large-sized burners. So, in case that the gas hob comprises four burners and four pieces of cookware should be heated at high-power burners, gas burners have to be used which do not have the desired power level.

SUMMARY OF THE INVENTION

It is an objective of the embodiments of the present invention to provide a gas burner with improved flexibility in view of the heating power range provided by the gas burner and high effectivity. If not explicitly indicated otherwise, embodiments of the invention and single features of said embodiments can be freely combined with each other.

According to an aspect, the invention relates to a gas burner comprising:

an injection holder with at least three gas injectors; and a burner crown assembly, the burner crown assembly comprising at least three flame rings with different sizes, the burner crown assembly further comprising at least three chambers and at least three pipes, each pipe being fluidly coupled with a single chamber.

Each gas injector is associated with one of said pipes for providing gas into said pipe, said pipe being adapted to receive primary air in the area of the injection holder and to provide a combustion mixture of gas and primary air to one of said flame rings of the burner crown assembly. In addition, adjacent flame rings are separated from each other based on an air gap provided between said adjacent flame rings.

Said gas burner is advantageous because due to said at least three different-sized flame rings said gas burner can provide a small heating power by only powering the smallest flame ring or a higher heating power by powering two or more of said flame rings. Based on said air gaps, secondary aeration is provided which increases the effectivity of the combustion process.

According to embodiments, said air gap comprises an annular shape and is concentrically arranged with respect to said flame rings. So, in other words, an annular flame ring is radially surrounded by said air gap. The radial width of the air gap may be in the range of 4 mm to 10 mm, particularly 6 mm to 8 mm. Thereby, the combustion process of the adjacent flame ring is significantly improved.

According to embodiments, said burner crown assembly enables an air flow below an outer chamber in order to provide air to said air gaps. So, in other words, air is sucked below the bottom wall portion of the burner crown assembly and preferably above the workplate and flows subsequently upwardly through said air gap.

According to embodiments, said burner crown assembly comprises a burner crown base portion on which at least one flame spreader building said flame rings is based on. Said burner crown base portion may comprise multiple subdivisions for forming lower boundaries for said chambers. The burner crown base portion may be integrally formed, i.e. said burner crown may be a single-piece element. The subdivisions forming said chambers may be linked by bars/webs, said bars/webs bridging the air gaps between said chambers. The burner crown base portion may also comprise said pipes.

According to embodiments, said burner crown base portion comprises wall portions for separating said chambers from said air gaps. Said wall portions may be side wall portions in order to laterally confine the chambers. Said wall portions may protrude upwardly from a bottom wall portion of said burner crown base portion.

According to embodiments, said wall portions are concentrically arranged in order to from concentric annular chambers. An inner chamber may be surrounded by an air gap, followed by a further chamber which surrounds said air gap. Similarly, said further chamber may be surrounded by a further air gap, said further air gap itself being surrounded by an outer chamber. Thereby a burner structure is obtained which ensures high efficiency of the gas burner.

According to embodiments, said pipes protrude downwardly from said burner crown base portion. Thereby, gas provided by a gas injector and ambient air can be received at a level below the bottom wall portion of the burner crown base portion.

According to embodiments, said flame rings are formed by one or more flame spreaders, wherein a flame spreader or a flame spreader portion comprises a protrusion protruding into the chamber in order to reduce the height of the chamber based on said protrusion. Said protrusion may be an arc-shaped protrusion. Based on said protrusion, the gas mixture distribution within the chamber can be balanced.

According to embodiments, said protrusion is located at a position within the chamber at which said pipe providing said combustion mixture of gas and primary air into said chamber is arranged. Thereby, the combustion mixture of gas and primary air is deflected at said protrusion and splitted in two gas flow portions propagating in opposite directions.

According to embodiments, the chambers are separated from each other with respect to the provision of a combustion mixture of gas and primary air into the respective chamber. So, the combustion gas mixture provided to a certain chamber is not able to flow into another chamber provided radial inwardly or outwardly. Thereby, said combustion gas mixture can be provided to each flame ring separately.

According to embodiments, each gas injector is coupled with a separate gas inlet. The gas inlet may be, for example, provided at the injection holder. Thereby it is possible to control the provision of gas separately to each chamber, respectively to each flame ring.

According to embodiments, the burner crown assembly is arranged above the injection holder. So, gas provided by the gas injectors arranged at the injection holder can flow upwardly into the respective chamber in order to be guided by said chamber towards the flame ports of the flame ring which are circumferentially arranged at the respective burner crown.

According to embodiments, the pipes are arranged at a lateral distance to each other. Thereby it is possible to arrange separate gas injectors below the free end of the pipes in order to provide selectively gas into said pipes.

According to embodiments, the pipes are arranged next to each other in a straight line. Said arrangement is advantageous because the provision of gas to said pipes is simplified. The arrangement of the gas injectors may be chosen similarly in order to enable a technically simple provision of gas to said pipes.

According to embodiments, the pipe of the inner burner crown is arranged in the centre of the burner crown assembly. Said configuration is advantageous because the inner burner crown comprises the smallest cross-sectional area and due to the centred arrangement of the pipe, the construction of the burner crown assembly is simplified and a homogenous flame formation at the first flame ring is obtained.

According to embodiments, the longitudinal axes of the pipes are vertically arranged. Thereby, the gas guided within the pipe can flow upwardly through the pipe thereby being mixed with the primary air sucked at the bottom of the pipe.

According to embodiments, the inner chamber is covered by a cup-shaped flame spreader. Said inner chamber may be a circular chamber and the cup-shaped flame spreader may close said circular chamber at the upper side. The further flame spreaders may be ring-shaped flame spreaders.

According to embodiments, each pipe comprises at its bottom an open free end. Said open free end provides an air inlet at which primary air is sucked in in order to be mixed with the gas provided by the gas injector. Said air inlet may be provided below a workplate of the gas burner.

According to embodiments, a spark plug and/or a thermocouple is provided in an air gap between the inner flame ring and a further flame ring adjacent to said inner flame ring. Thereby the ignition behaviour and operational safety is significantly improved.

According to a further aspect, the invention refers to a gas hob with a gas burner configured according to anyone of the preceding embodiments.

The terms "essentially", "substantially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
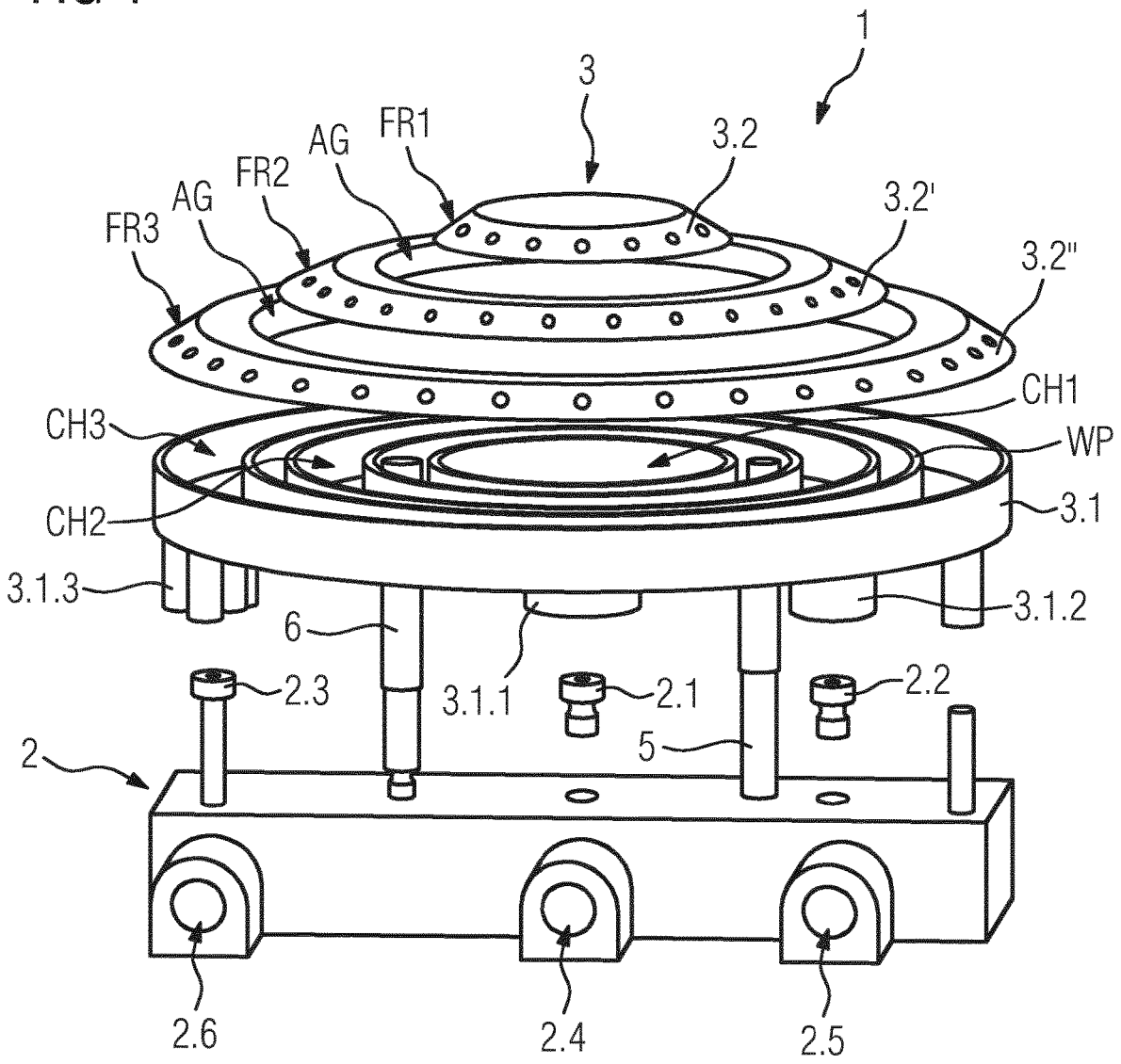
FIG. 1 shows an example exploded perspective view of the gas burner according to an embodiment.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 illustrates an embodiment of a gas burner 1 according to an exploded view. The gas burner 1 comprises an injector holder 2. Said injector holder 2 may be adapted to be arranged below a work plate W of a gas hob. In other words, the injector holder 2 may be at least partially integrated in the cooktop. The injector holder 2 comprises gas inlets 2.4, 2.5, 2.6 which are fluidly coupled with gas injectors 2.1, 2.2, 2.3.

According to an embodiment, the injector holder 2 may comprise multiple end faces. For example, the injector holder 2 may comprise a bar or T-like shape and the gas inlets 2.4, 2.5, 2.6 are provided at the free ends or side portions of said injector holder 2. The gas injectors 2.1, 2.2, 2.3 may be arranged at an upper side of the injector holder 2 in order to provide an upwardly directed gas flow. For example, the gas injectors 2.1, 2.2, 2.3 may be arranged next to each other along a straight line.

In addition, the gas burner 1 comprises a burner crown assembly 3. The burner crown assembly 3 may be adapted to be arranged above the injector holder 2. The burner crown assembly 3 may comprise multiple parts, namely a burner crown base portion 3.1, and one or more flame spreaders 3.2, 3.2', 3.2". Said flame spreaders 3.2, 3.2', 3.2" may be adapted to form flame rings FR1, FR2, FR3. The flame spreaders 3.2, 3.2', 3.2" may be formed by separate pieces or a single flame spreader may be provided which comprises multiple flame spreader portions, each flame spreader/flame spreader portion forming a flame ring FR1, FR2, FR3. Said one or more flame spreaders 3.2, 3.2', 3.2" are adapted to be arranged on top of the burner crown base portion 3.1.

More in detail, the burner crown base portion 3.1 comprises a cup-like shape with a bottom portion and an outer wall portion protruding upwardly for radially confining the gas burner 1. In addition, said burner crown base portion 3.1 comprises multiple wall portions WP. Said wall portions WP are arranged at a radial inner position with respect to the outer wall portion. In addition, said wall portions WP may be arranged concentrically with respect to the outer wall portion. Based on said outer wall portion and said wall portions WP multiple chambers CH1, CH2, CH3 are radially confined within the gas burner 1. Each one of the one or more flame spreaders 3.2, 3.2', 3.2" or flame spreader portions may be associated with a certain chamber CH1, CH2, CH3. More in detail, said flame spreaders 3.2, 3.2', 3.2" or flame spreader portions may be arranged on top of said burner crown base portion 3.1 in order to confine the chambers CH1, CH2, CH3 in an upward direction. Said chambers CH1, CH2, CH3 may be, for example, radial Venturi effect chambers. Said chambers CH1, CH2, CH2 may be arranged radially next to each other.

The first, inner chamber CH1 may be covered by a circular, cup-shaped flame spreader 3.2. The outer diameter of said first chamber CH1 may be in the range of 45 mm to 55 mm, specifically 50 mm, 51 mm or 52 mm. The following chambers CH2, CH3 may comprise ring-shaped flame spreaders 3.2', 3.2". The outer diameter of the second chamber CH2 may be in the range of 85 mm to 100 mm, specifically between 90 mm and 95 mm, particularly 92 mm, 93 mm or 94 mm. The outer diameter of the third chamber CH3 may be in the range of 130 mm to 145 mm, specifically between 135 mm and 140 mm, particularly 136 mm, 137 mm or 138 mm. The height of the chambers may be in the range of 10 mm to 15 mm, specifically 12 mm, 13 mm or 14 mm, particularly 13.5 mm.

Figure 2:
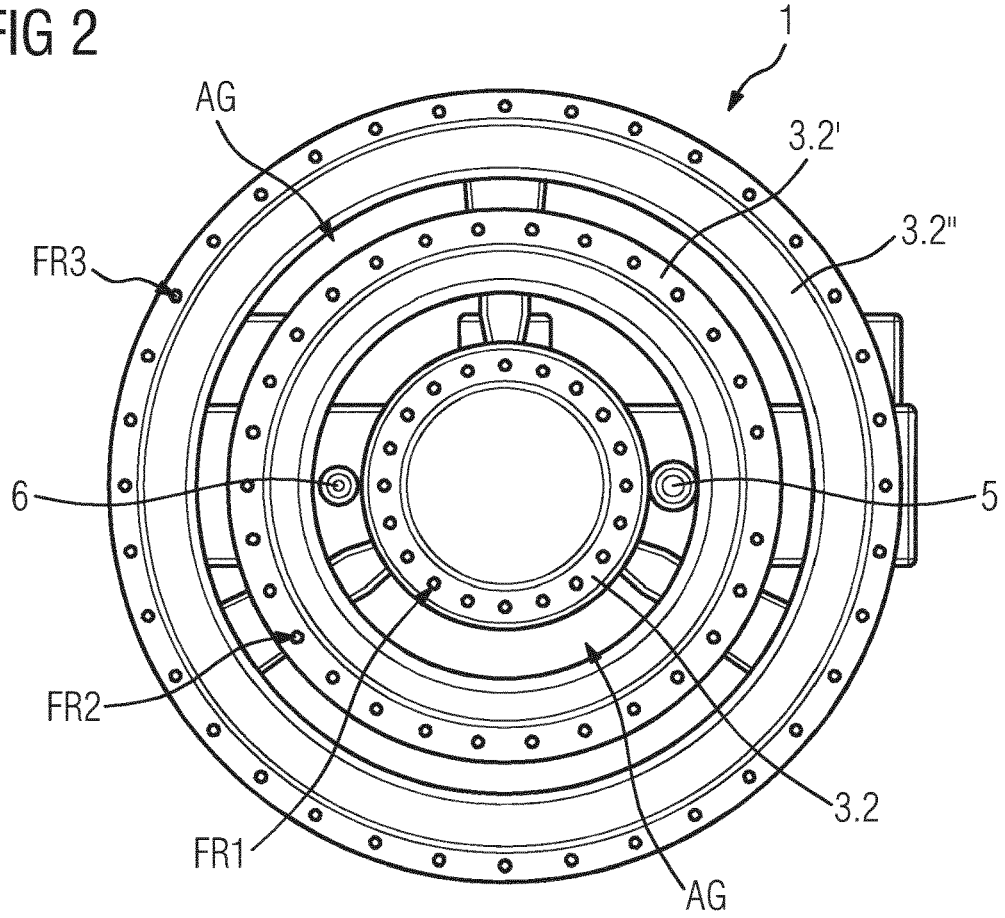
FIG. 2 shows an example top view of the gas burner according to FIG. 1.

In order to provide a combustion gas mixture, each flame spreader 3.2, 3.2', 3.2" forms a flame ring FR1, FR2, FR3. Said flame ring FR1, FR2, FR3 is provided circumferentially at the respective flame spreader 3.2, 3.2', 3.2". As shown in FIG. 2, the flame rings FR1, FR2, FR3 may be arranged in a concentric manner with respect to a vertical middle axis of the gas burner 1, respectively its burner crown assembly 3. The flame rings FR1, FR2, FR3 may be constituted by multiple openings or grooves provided at a circumferential slanted side wall of the flame spreaders 3.2, 3.2', 3.2". Said openings or grooves form flame ports of the burner.

In order to be able to selectively provide a combustion gas mixture in a certain chamber CH1, CH2, CH3, the chambers CH1, CH2, CH3 are separated from each other based on upper-mentioned wall portions and said combustion gas mixture is provided separately to each chamber CH1, CH2, CH3. More in detail, the burner crown assembly 3, specifically the burner crown base portion 3.1 comprises multiple pipes 3.1.1, 3.1.2, 3.1.3 adapted to provide a combustion gas mixture to said chamber CH1, CH2, CH3. Each pipe 3.1.1, 3.1.2, 3.1.3 may be associated with a certain chamber CH1, CH2, CH3. For example, a first pipe 3.1.1 may be adapted to provide said combustion gas mixture to the first chamber CH1, a second pipe 3.1.2 may be adapted to provide said combustion gas mixture to the second chamber CH2 and the third pipe 3.1.3 may be adapted to provide said combustion gas mixture to the third chamber CH3. Said pipes 3.1.1, 3.1.2, 3.1.3 may be Venturi effect pipes.

Said pipes 3.1.1, 3.1.2, 3.1.3 may be vertically arranged within the burner crown assembly 3, i.e. the longitudinal axis of the respective pipe 3.1.1, 3.1.2, 3.1.3 is vertically or essentially vertically arranged. Said pipes 3.1.1, 3.1.2, 3.1.3 may be, for example, an integral part of said burner crown base portion 3.1. The pipes 3.1.1, 3.1.2, 3.1.3 may protrude at the lower side of the burner crown base portion 3.1. Specifically, said burner crown base portion 3.1 may comprise a bottom wall portion at which said pipes 3.1.1, 3.1.2, 3.1.3 protrude downwardly. Each pipe 3.1.1, 3.1.2, 3.1.3 may comprise a first free end arranged within the respective chamber CH1, CH2, CH3 and a further free end arranged below the respective chamber CH1, CH2, CH3. Said further free end may be arranged closely above a gas injector 2.1, 2.2, 2.3. Thereby, the each gas injector 2.1, 2.2, 2.3 may be able to provide an upwardly directed steam of gas into said pipe 3.1.1, 3.1.2, 3.1.3 and said pipe 3.1.1, 3.1.2, 3.1.3 guides the gas into the chamber CH1, CH2, CH3 in which its upper free end is located.

The lower free ends of the pipe 3.1.1, 3.1.2, 3.1.3 may be at least partially open in order to be able to suck primary air. Said primary air is mixed within the respective pipe 3.1.1, 3.1.2, 3.1.3 and the chambers CH1, CH2, CH3 in order to provide a combustion gas mixture at the flame rings FR1, FR2, FR3.

As shown in FIG. 1, said pipes 3.1.1, 3.1.2, 3.1.3 are arranged at a distance to each other. The pipe 3.1.1 (fluidly connected with the first, inner chamber CH1) may be arranged essentially in the center of the burner crown assembly 3 and the pipes 3.1.2, 3.1.3 may be arranged at opposite sides of said pipe 3.1.1. The gas injectors 2.1, 2.2, 2.3 may be arranged at the injection holder 2 such that— in the assembled state of the gas burner 1—the lower free ends of the pipes 3.1.1, 3.1.2, 3.1.3 are arranged directly above the respective gas injector 2.1, 2.2, 2.3.

Due to the different size of the flame rings FR1, FR2, FR3, respectively the flame spreaders 3.2, 3.2', 3.2", the gas burner 1 provides multiple gas burner stages with different heating power. For example, small-sized flame ring FR1 may provide lower heating power than flame ring FR2 and flame ring FR2 may provide lower heating power than flame ring FR3.

The gas burner 1 may be adapted to be driven according to a three-stage power concept, namely a lower power stage in which only the first flame ring FR1 is active, a medium power stage in which the first and the second flame ring FR1, FR2 is active, and a maximum power level in which all flame rings FR1, FR2, FR3 are active. So, in other words, the flame ring FR1, FR2, FR3 are gradually switched on starting with the inner flame ring when increasing the heating power. The heating power may be varied in the range of 0.3 KW to 5 KW, specifically between (0.5 KW to 4 KW).

Figure 3:
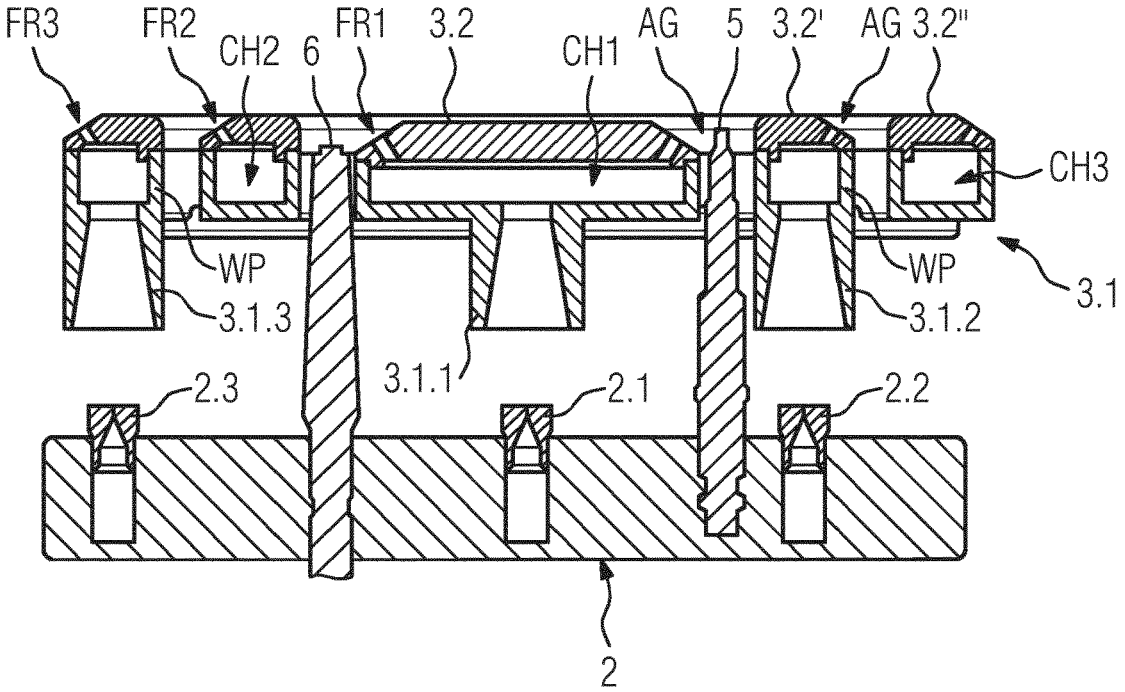
FIG. 3 shows a lateral sectional side view of a gas burner according to FIGS. 1 and 2.
Figure 4:
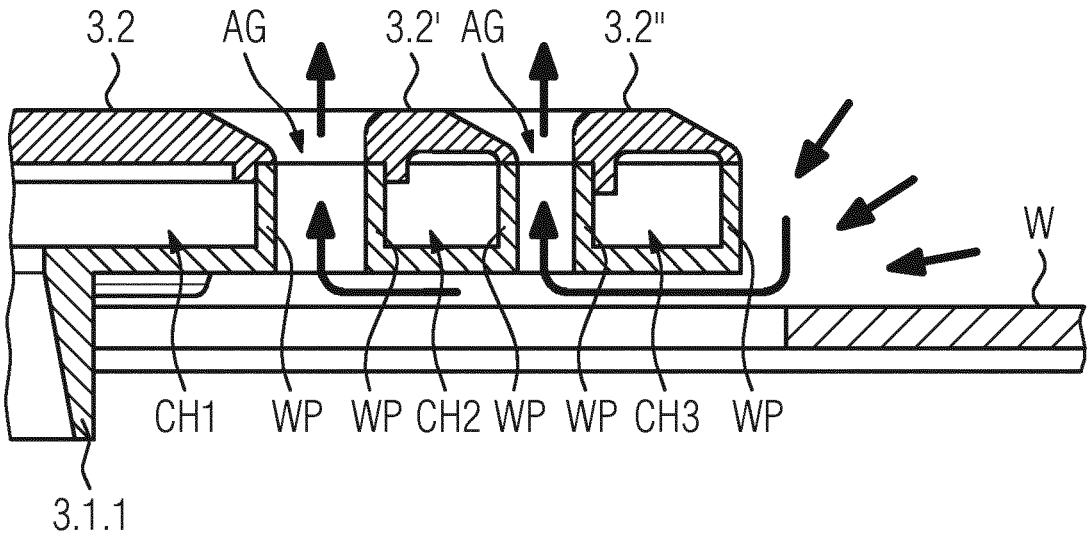
FIG. 4 illustrates a secondary aeration effect caused by air gaps provided between adjacent flame rings.

As shown in FIGS. 2 to 4, air gaps AG are provided between adjacent flame rings FR1, FR2, FR3, respectively, flame spreaders 3.2, 3.2', 3.2". More in detail, a first air gap AG may be provided between an inner and a middle flame ring FR1, FR2 and a second air gap AG may be provided between a middle and an outer flame ring FR2, FR3. Said air gap AG may be provided by a space between adjacent chambers CH1, CH2, CH3. Said air gap AG may comprise an annular or essentially annular shape. As shown based on the arrows in FIG. 4, the burner crown base portion 3.1 may be arranged at a distance to a bottom hob portion in order to allow an air flow below the bottom wall portion of said burner crown base portion 3.1. Said air gaps AG enable a vertically upward-directed air flow between adjacent flame rings FR1, FR2, FR3. Thereby, a further aeration between said flame rings FR1, FR2, FR3 is obtained which improves the combustion. Specifically, said secondary aeration improves combustion.

The spark plug 5 and the thermocouple 6 may be arranged in the air gap AG between the inner flame ring FR1 and the subsequent flame ring FR2. Thereby the spark plug 5 is able to activate the inner flame ring FR1 and control its state based on the thermocouple 6.

Figure 5:
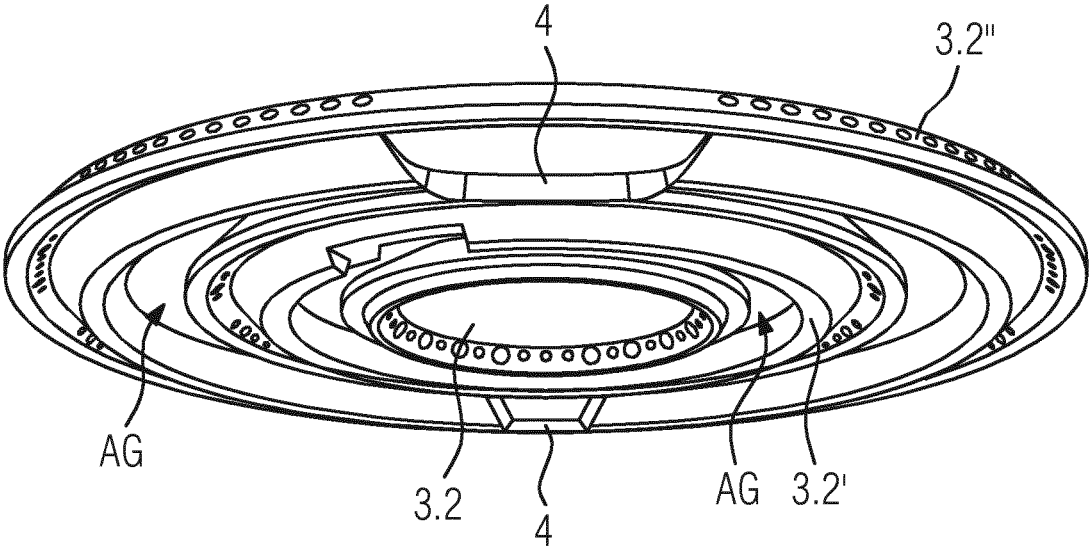
FIG. 5 shows a lower perspective view of a flame spreader assembly with protrusions at the bottom side.
Figure 6:
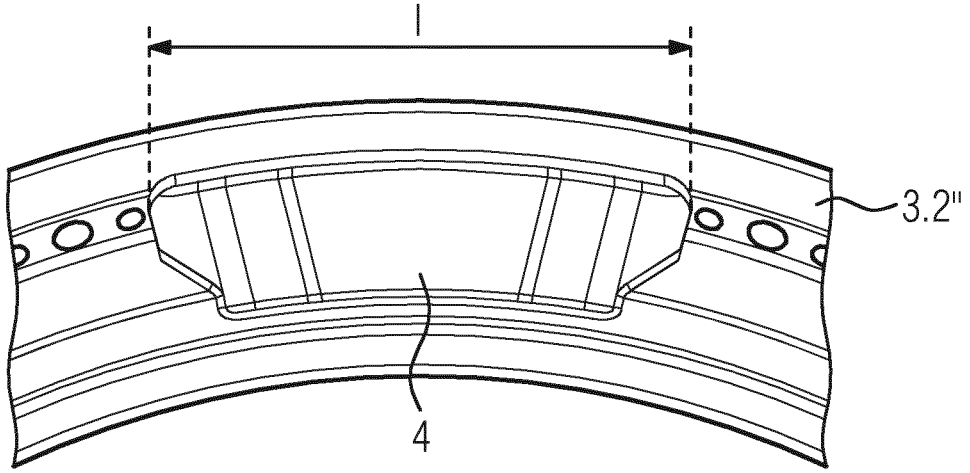
FIG. 6 shows a section of a ring-shaped flame spreader with an arc-shaped protrusion.
Figure 7:
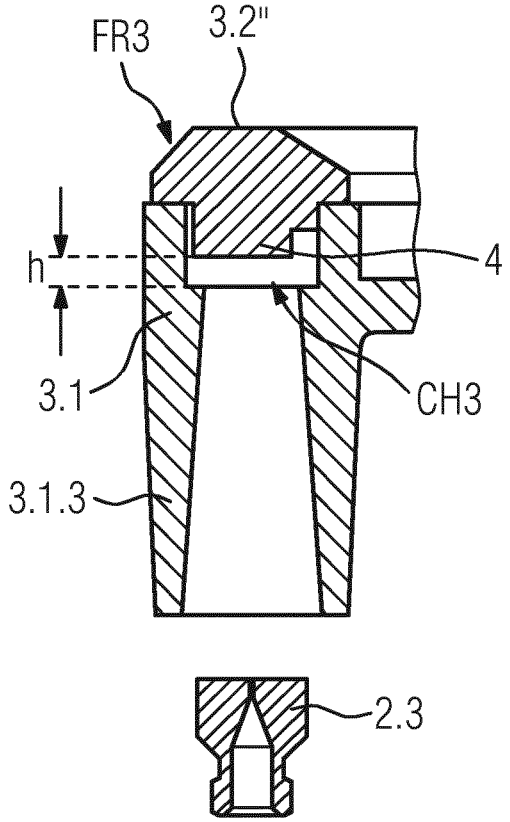
FIG. 7 shows a sectional view of a pipe and a flame spreader comprising a protrusion at a bottom side, said protrusion projecting into a chamber confined between the burner crown base portion and the flame spreader.

FIGS. 5 to 7 show flame spreaders 3.2, 3.2', 3.2" in closer detail. Said middle and outer flame spreaders 3.2', 3.2" may comprise a protrusion 4, protruding downwardly from said flame spreaders 3.2', 3.2". Based on said protrusion 4, the cross section of the chambers CH2, CH3 are reduced because said protrusion 4 extends from said flame spreaders 3.2', 3.2" downwardly into the respective chamber CH2, CH3. So in other words, said protrusion 4 reduces the height h of the chamber CH2, CH3.

The position of the protrusion 4 may be chosen such that the protrusion 4 is arranged above the free end of the pipe 3.1.2, 3.1.3, through which the combustion gas mixture is provided into said chamber CH2, CH3 (cf. FIG. 7). Based on said protrusion 4, the combustion gas mixture is deflected in a circumferential direction and preferably splitted in two combustion gas portions propagating in opposite directions. Thereby, the flame distribution around the respective flame ring FR2, FR3 is balanced. The protrusions 4 of the respective flame spreaders 3.2', 3.2" may be provided at opposite sides of the center of the burner crown assembly 3, similar to the chosen position of the pipes 3.1.2, 3.1.3.

The height h of the protrusion 4 may be chosen such that the height of the chamber CH2, CH3 in the area of the protrusion 4 is in the range between 2 mm and 4 mm. The height of the protrusions 4 may decrease towards its outer ends. The length 1 of the protrusion 4 may be in the range between 10 mm and 40 mm, specifically between 13 mm and 32 mm.

In the disclosure before, an embodiment with three flame rings, respectively, flame spreaders have been described. It is worth mentioning that the gas burner may comprise even more than three flame rings, respectively, flame spreaders, e.g. four or five flame rings/flame spreaders.

It should be noted that the description and drawings merely illustrate the principles of the proposed gas burner. Those skilled in the art will be able to implement various arrangements that, although not explicitly described or shown herein, embody the principles of the invention.

LIST OF REFERENCE NUMERALS

1 gas burner
2 injection holder
2*a* injection holder portion
2*b* injection holder portion
2.1, 2.2, 2.3 gas injector
2.4, 2.5, 2.6 gas inlet
3 burner crown assembly
3.1 burner crown base portion
3.1.1 pipe
3.1.2 pipe
3.1.3 pipe
3.2 flame spreader
3.2' flame spreader
3.2" flame spreader
4 protrusion
5 spark plug
6 thermocouple
AG air gap
CH1 first chamber
CH2 second chamber
CH3 third chamber
FR1 first flame ring
FR2 second flame ring
FR3 third flame ring
l length
h height
W workplate
WP wall portion

The invention claimed is:

1. Gas burner comprising:

an injection holder with at least three gas injectors;

a burner crown assembly comprising at least three flame rings with different sizes, the burner crown assembly further comprising at least three chambers and at least three pipes, each said pipe being fluidly coupled with a single one of said chambers;

wherein each said gas injector is associated with one of said pipes for providing gas into the respective pipe, each said pipe being adapted to receive primary air in an area of the injection holder and to provide a combustion mixture of gas and primary air to one of said flame rings of the burner crown assembly, wherein adjacent ones of said flame rings are separated from each other based on a respective air gap provided between said adjacent flame rings; and wherein said flame rings are formed by one or more flame spreaders, wherein each said flame spreader or a flame spreader portion thereof comprises a protrusion protruding into the associated chamber in order to reduce a height of the associated chamber based on said protrusion, a length of the protrusion being less than a circumference of the flame spreader.

2. The gas burner according to claim 1, wherein each said air gap comprises an annular shape and is concentrically arranged with respect to said flame rings.

3. The gas burner according to claim 1, wherein said burner crown assembly enables an air flow below an outer one of said chambers in order to provide air to said air gaps.

4. The gas burner according to claim 1, wherein said burner crown assembly comprises a burner crown base portion on which at least one flame spreader building said flame rings is based.

5. The gas burner according to claim 4, wherein said burner crown base portion comprises wall portions for separating said chambers from said air gaps.

6. The gas burner according to claim 5, wherein said wall portions are concentrically arranged in order to form said chambers as concentric annular chambers.

7. The gas burner according to claim 1, wherein said pipes protrude downwardly from said burner crown base portion.

8. The gas burner according to claim 1, wherein said protrusion is located at a position within the associated chamber at which said pipe providing said combustion mixture of gas and primary air into said chamber is arranged.

9. The gas burner according to claim 1, wherein each said gas injector is coupled with a separate gas inlet.

10. The gas burner according to claim 1, wherein the burner crown assembly is arranged above the injection holder.

11. The gas burner according to claim 1, wherein the pipes are arranged at a lateral distance to each other.

12. The gas burner according to claim 1, wherein longitudinal axes of the pipes are vertically arranged and/or each pipe comprises at its bottom an open free end.

13. The gas burner according to claim 1, wherein a spark plug and/or a thermocouple is provided in the air gap between an inner one of said flame rings and a further one of said flame rings adjacent to said inner flame ring.

14. Cooking hob comprising the gas burner according to claim 1.

15. The gas burner according to claim 11, said pipes being arranged next to each other in a straight line.

16. A gas burner comprising an injection holder comprising first, second and third gas inlets fluidly coupled respectively to first, second and third gas injectors, and a burner crown assembly comprising a base portion and a plurality of flame spreaders;

said base portion defining first, second and third chambers isolated from one another;

a first pipe providing fluid communication between said first gas injector and said first chamber, a second pipe providing fluid communication between said second gas injector and said second chamber, and a third pipe providing fluid communication between said third gas injector and said third chamber;

said plurality of flame spreaders comprising first, second and third flame spreaders covering and thereby confining the respective first, second and third chambers defined in said base portion, each said flame spreader having a respective plurality of flame ports disposed about a circumference thereof and adapted to provide respective first, second and third flame rings;

said first, second and third chambers, and likewise said first, second and third flame spreaders, being concentric and radially spaced from one another defining respective first and second air gaps therebetween, such that said first flame spreader and first chamber are located at a center of said burner crown assembly and are circular, said second flame spreader and second chamber are located radially outward thereof and spaced therefrom by said first air gap and are ring shaped, and said third flame spreader and third chamber are located radially outward thereof and spaced therefrom by said second air gap and are ring shaped;

said burner being adapted to be operated in a low-power mode wherein combustible gas is fed via a first gas pathway from said first gas inlet, through said first injector and first pipe into said first chamber, and then eluted and combusted via the flame ports defining said first flame ring of said first flame spreader;

said burner being further adapted to be operated in a maximum-power mode wherein combustible gas is fed through:

said first gas pathway, a second gas pathway from said second gas inlet, through said second injector and second pipe into said second chamber, and is then eluted and combusted via the flame ports defining said second flame ring of said second flame spreader, and a third gas pathway from said third gas inlet, through said third injector and third pipe into said third chamber, and is then eluted and combusted via the flame ports defining said third flame ring of said third flame spreader; and said burner being further adapted to operate in an intermediate-power mode wherein combustible gas is fed through only said first and second gas pathways.

17. The gas burner of claim 16, said first, second and third pipes all extending vertically upward and being further arranged along a common plane, said first, second and third pipes having respective lower free ends aligned with and disposed above the respective first, second and third gas injectors and being further adapted to suck primary air therein to be mixed with combustible gas received form the gas injectors in order to yield respective combustion mixtures delivered to the first, second and third chambers, respectively.

18. The gas burner of claim 17, said air gaps being adapted to facilitate a flow of secondary air therethrough in order to enhance combustion at the adjacent flame rings.

19. Gas burner comprising:

an injection holder with at least three gas injectors;

a burner crown assembly comprising at least three flame rings with different sizes, the burner crown assembly further comprising at least three chambers and at least three pipes, each said pipe being fluidly coupled with a single one of said chambers;

wherein each said gas injector is associated with one of said pipes for providing gas into the respective pipe, each said pipe being adapted to receive primary air in the area of the injection holder and to provide a combustion mixture of gas and primary air to one of said flame rings of the burner crown assembly, wherein adjacent ones of said flame rings are separated from each other based on a respective air gap provided between said adjacent flame rings, each said pipe extending vertically upward and being further arranged along a common plane, each said pipe a having a respective lower free end aligned with and disposed above respective one of said three gas injectors and being further adapted to suck primary air therein to be mixed with combustible gas received form the gas injectors in order to yield respective combustion mixtures delivered to respective one of said three chambers.

20. The gas burner of claim 19, said air gaps being adapted to facilitate a flow of secondary air therethrough in order to enhance combustion at the adjacent flame rings.

* * * * *